US005190325A

United States Patent [19]

Doss-Desouza

[11] Patent Number: 5,190,325

[45] Date of Patent: Mar. 2, 1993

[54] MAGNETIC CATCH

[75] Inventor: Argus Doss-Desouza, Sunningdale, England

[73] Assignee: Technophone Limited, Surrey, England

[21] Appl. No.: 863,809

[22] Filed: Apr. 6, 1992

[30] Foreign Application Priority Data

Apr. 12, 1991 [GB] United Kingdom ..... 9107822

[51] Int. Cl.[5] ..... E05C 17/56

[52] U.S. Cl. ..... 292/251.5; 292/DIG. 60

[58] Field of Search ..... 292/251.5, DIG. 53, 292/DIG. 60

[56] References Cited

U.S. PATENT DOCUMENTS

| | | | |
|---|---|---|---|
| 2,770,759 | 11/1956 | Ahlgren | 292/251.5 |
| 3,204,995 | 9/1965 | Teetor | 292/251.5 |
| 3,976,316 | 8/1976 | Laby | 292/251.5 |

FOREIGN PATENT DOCUMENTS 2215771A 9/1989 Japan .

*Primary Examiner*—Richard E. Moore
*Attorney, Agent, or Firm*—Perman & Green

[57] ABSTRACT

A magnetic catch comprises a magnetic assembly and a catch plate. The magnetic assembly includes a magnet flanked by two pole shoes. The magnet and pole shoes are biassed against a casing portion by an abutment feature provided integrally on a support member which is retained by resilient clips extending from the casing. The localized nature of the abutment feature provides a gap between the pole plates and the support member. This gap allows the pole members to move relative to the magnet so that they can align themselves with the catch plate to provide optimal physical contact therewith. Nevertheless, the biasing arrangement holds the magnet in a fixed position which helps to prevent the magnet and pole shoes from rattling.

14 Claims, 1 Drawing Sheet

MAGNETIC CATCH

This invention relates to a magnetic assembly for a magnetic catch, and further relates to a magnetic catch comprising such a magnetic assembly.

BACKGROUND OF THE INVENTION

A known type of magnetic catch comprises two main parts, namely a magnetic assembly and a catch plate. The magnetic assembly conventionally includes a magnet flanked by a pair of pole members. The pole members extend through respective apertures in an outer casing so that they may physically contact the catch plate and thereby provide a strong magnetic grip and hence a firm locking action between the two parts of the catch.

Magnetic catches tend to be relatively simple, low cost devices which have found widespread use in numerous applications, for example in the furniture industry as door catches.

In a known version of the aforementioned type of magnetic catch the pole members are fixed relative to the casing. This fixed arrangement is disadvantageous because, unless there is substantial co-planarity between the catch plate and the abutting edges of the pole members, e.g. if the catch plate has an uneven surface, there will tend to be discontinuous or irregular contact between the pole members and the catch plate and hence the gripping effect between the two parts will be impaired.

It is also known to mount the magnet and pole members in such manner as to permit a certain amount of movement relative to the outer casing. With this arrangement the pole members can align themselves with the catch plate to provide optimal physical contact therewith thus ensuring maximum gripping action. However, a drawback with this arrangement is that the magnet and pole members are mounted only relatively loosely within the casing and hence there is a tendency for them to move about and rattle particularly when the catch plate is not in place. This is a particular disadvantage where the catch is intended for use in a mobile environment such as, for example, inside a motor vehicle where it is desirable to minimize stray noise such as rattles. For example, magnetic catches are frequently used with mobile telephones installed in vehicles for holding the handset firmly on the cradle when the handset is not in use. In this application it would clearly be distracting if the magnetic catch was prone to rattle.

SUMMARY OF THE INVENTION

According to a first aspect of the present invention there is provided a magnetic assembly for a magnetic catch, comprising a magnet having front, rear, and side faces, a pair of pole members disposed respectively adjacent two opposite side faces of said magnet, each pole member comprising a portion which is proud of the front face of the magnet, a casing have at least one aperture for receiving the proud portions of the pole members, a support member comprising abutment means disposed adjacent the rear face of the magnet, and means for holding the support member such that the abutment means biases the magnet towards the aperture in the casing, the support member being adapted to allow movement of the pole members relative to the magnet in the fore and aft direction.

A magnetic assembly in accordance with the invention has the advantage that the pole members have the freedom to move independently within the casing relative to the magnet so that they can align themselves to provide optimal physical contact with the catch plate. On the other hand the magnet itself is held in a fixed position relative to the casing by the biasing arrangement which presses the front face of the magnet against the portion of the casing surrounding the aperture. This helps to prevent the magnet and pole pieces from rattling within the casing, particularly when the catch is not in use (i.e. not in engagement with the catch plate.) The construction and assembly of the present magnetic assembly is nevertheless relatively simple and, consequently, inexpensive.

Preferably the casing comprises two apertures for receiving the respective proud portions of the two pole members. In this case the portion of the casing between the two apertures acts as an abutment for the forwardly-biased magnet, thus limiting the forward movement of both the magnet and the pole members.

Preferably the abutment means is provided at a localized position on the support member. For example the abutment means may be centrally disposed relative to the rear face of the magnet. In a preferred embodiment the abutment means is in the form of a convex protuberance provided integrally with the support member. This arrangement has the advantage of permitting the magnet and pole members limited movement within the casing, i.e. until the rear edges of the pole members abut the portion of the support member outside the area of the abutment means.

Alternatively the abutment means may be a separate member, such as for example spring means fastened to the support member.

In a particular embodiment the support member is adapted to be flexible in the direction of the front face of the magnet. Specifically, the support member may be adapted to flex in the vicinity of the abutment means. This flexibility promotes the biasing effect on the magnet while compensating for the tolerances in the various components of the magnetic assembly.

According to a further aspect of the present invention there is provided a magnetic catch comprising a magnetic assembly in accordance with the first aspect of the invention, and further comprising a catch plate comprising material capable of attraction by the magnet.

BRIEF DESCRIPTION OF THE DRAWINGS

An embodiment of the invention will now be described, by way of example, with reference to the accompanying drawings, in which.

DETAILED DESCRIPTION OF THE PREFERRED EMBODIMENT

Figure 1:
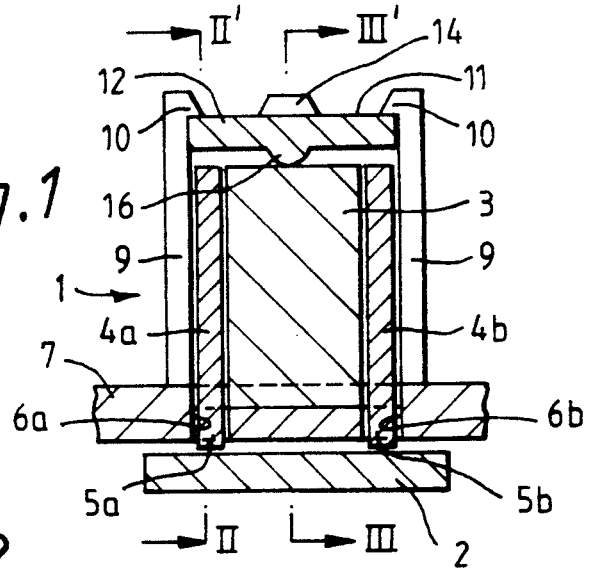
FIG. 1 is a cross section of a magnetic catch in accordance with the present invention.
Figure 2:
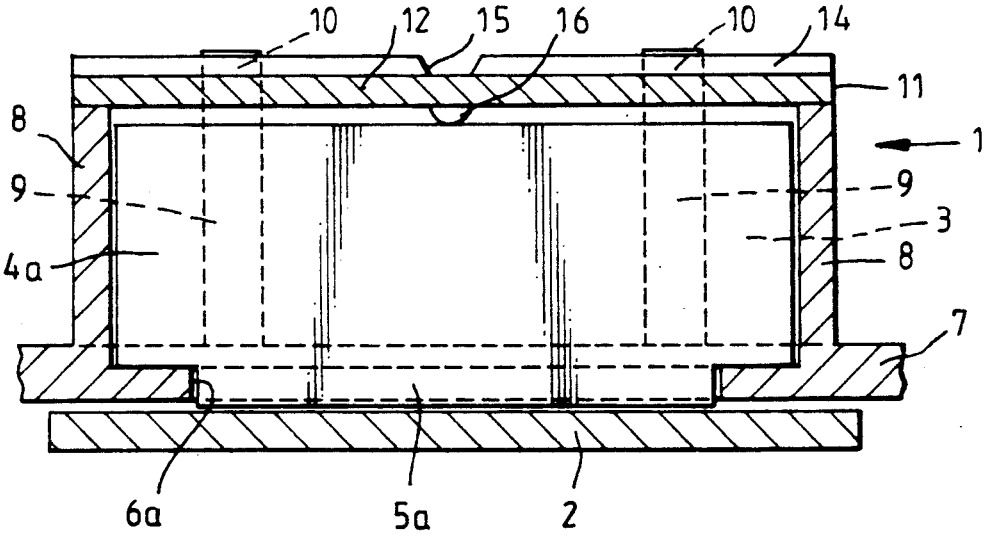
FIG. 2 is a cross section of the magnetic catch taken on the line II—II' in FIG. 1.
Figure 3:
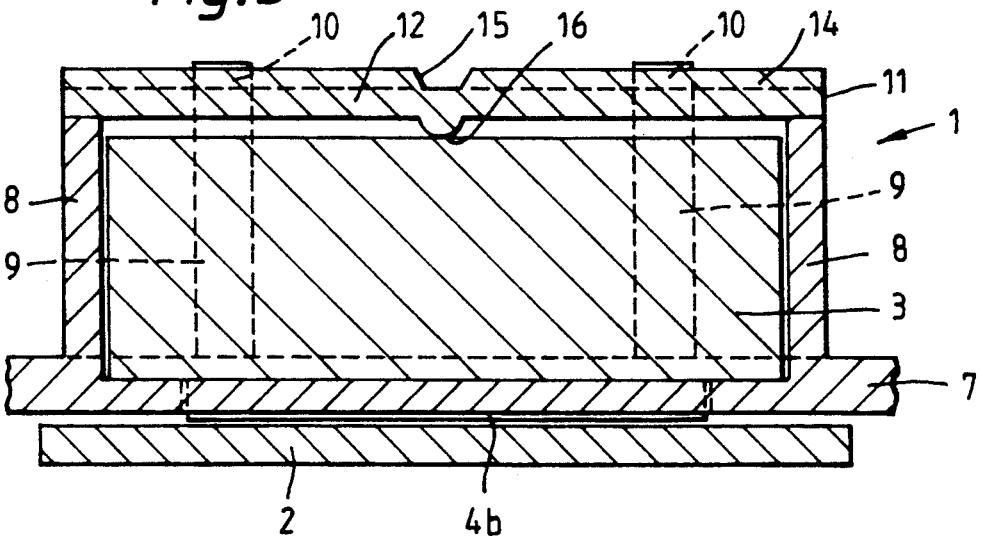
FIG. 3 is a cross section of the magnetic catch taken on the line III—III' in FIG. 1.

Referring to FIGS. 1 to 3, the magnetic catch illustrated therein, comprises a magnetic assembly 1 and a catch plate 2. The catch plate is made of a material susceptible to magnetic attraction such as, for example, steel. The magnetic assembly comprises a ferrite magnet 3 in the shape of an elongate rectangular block. A pair of flat pole shoes 4*a*,4*b* made for example of steel are provided in contiguous relationship against the two major side faces of the magnet 3. Magnetic attraction holds the pole shoes 4*a*,4*b* firmly against the side faces of the magnet 3. The pole shoes 4*a* and 4*b* are generally rectangular, but include an extended rectangular portion 5*a* and 5*b* respectively which extend into apertures 6*a* and 6*b* in an outer casing 7. The pole shoes 4*a*,4*b* thus have a generally T-shaped profile and the front edge of the horizontal limb of the T presents a shoulder which engages the portion of the casing adjacent the ends of apertures 6*a*,6*b* thus preventing the pole shoes 4*a*,4*b* from being withdrawn through the front of the casing 7. Only part of the casing is shown in the figures, i.e. the part adjacent the front face of the magnet 3, since the remainder of the casing is not relevant to the instant invention. It should be noted, however, that the casing may be restricted to enclose only the catch assembly components, or a common casing may be used to house other devices or apparatus. The casing which suitably is moulded from a plastics material, includes two upstanding members 8 formed integrally therewith, disposed adjacent the minor side faces of the magnet 3. The upstanding members 8, which extend slightly proud of the rear face of the magnet 3, act to retain the magnet in the longitudinal direction. Four upstanding resilient clip members 9 are also formed integrally with the casing 7, two clip members being disposed adjacent each major side face of the magnet 3. The clip members each comprise a barb 10 at the end remote from the casing. The barbs 10 bear against a separate support member 11 which itself spans the upstanding members 8. The support member 11, which may be moulded from plastics material, comprises a generally flat rectangular plate portion 12 having two co-linear longitudinal ridges 14 formed integrally on the rear (outward) face thereof disposed approximately in line with the longitudinal axis of the support member and extending from the respective shorter edges thereof. The ridges are spaced apart by a gap 15 substantially at the central point of the support member 11. In cross-section the gap has a truncated V-shape. The ridges 14 generally impart stiffness to the support member 11, whereas the gap 15 offers a weaker area which enables the support member to flex into a generally V-shaped configuration about its transverse axis. This flexure accommodates tolerances in the thickness of the support member 11 and the magnet 3. The support member 11 also comprises on the front (inward) face a substantially centrally disposed bump in the form of a convex protuberance 16 formed integrally therewith. The bump 16 bears against the rear face of the magnet 3. The combined effect of the clip members 8 and the flexure provided in the support member 11 causes the bump 16 to bias the magnet 3 in a forward direction until the front face of the magnet 3 abuts the portion of the casing 7 surrounding and between the apertures 6*a* and 6*b*. The biasing arrangement thus holds the magnet in a fixed position relative to the casing. Because of the magnetic attraction between the pole shoes 4*a*,4*b* and the magnet 3 the pole shoes 4*a*,4*b* generally move forward in unison with the magnet whereby the extended portions 5*a*,5*b* of the pole shoes extend through the apertures 6*a*,6*b* in the casing 7 enabling the pole shoes to physically engage the catch plate 2. However, the localized nature of the bump 16 means that there is a gap between the rear edge of the pole plates 4*a*,4*b* and the portion of the front face of the support member 11 adjacent the pole plates. This gap enables the pole shoes 4*a*,4*b* to move to a limited extent in the fore and aft direction relative to the magnet 3, i.e. until the rear edges of plates 4*a*, 4*b* abut the front face of the the pole support member 11. This limited movement capability enables each of the pole shoes independently to adopt the optimum alignment for maximum contact with the catch plate 2, thus achieving a firm locking effect between the two parts of the catch even when the catch plate has an uneven surface. It is noted that the pole members 4*a*,4*b* move by sliding over the respective side faces of the magnet overcoming the force of the magnetic attraction therebetween.

Although the magnet and pole shoes have a limited freedom of movement the biasing arrangement tends to prevent undue movement of both the magnet and the pole shoes and so avoid rattling of the components within the casing 7.

In view of the foregoing description it will be evident to a person skilled in the art that various modifications may be made within the scope of the invention. For example the abutment means on the support member need not be provided as a convex bump, but may instead for example be in the form of one or more posts or ridges or indeed any other form of localised abutment feature. Moreover it is not necessary for the abutment means to be formed integrally with the support member but may be coupled thereto. For example a spring such as a leaf spring or coil spring may be used. The leaf spring may be fastened to the front face of the support member whereas the coil spring may simply be located loosely on a post provided on the support member but held in place by compression between the support member and the magnet.

Finally, it will be readily apparent to a person skilled in the art that the dimensions for the magnet and pole shoes and the other components of the magnetic assembly may be chosen to suit the particular application and therefore specific dimensions have not been recited in the present description.

I claim:

1. A magnetic assembly for a magnetic catch, comprising:

a magnet having front, rear, and side faces, a pair of pole members disposed respectively adjacent to opposite side faces of said magnet, each pole member comprising a portion which is proud of the front face of the magnet, a casing having at least one aperture for receiving the proud portions of the pole members, a unitary plate-like support member comprising abutment means disposed adjacent the rear face of the magnet, the abutment means being in the form of a localized protuberance extending proud of the support member, the support member being disposed to overlie the magnet and both pole members so as to limit their movement, and means for holding the support member such that the abutment means biases the magnet towards the aperture in the casing, the support member being adapted to allow movement of the pole members relative to the magnet in the fore and aft direction.

2. A magnetic assembly as claimed in claim 1, wherein the casing comprises a pair of apertures for receiving the respective proud portions of the two pole members.

3. A magnetic assembly as claimed in claim 1, wherein the abutment means is provided at a localised position on the support member.

4. A magnetic assembly as defined in claim 3, wherein the abutment means is substantially centrally disposed relative to the rear face of the magnet.

5. A magnetic assembly as claimed in claim 1 wherein said protuberance is convex.

6. A magnetic assembly as claimed in claim 1, wherein the support member is adapted to be flexible in the direction of the front face of the magnet.

7. A magnetic assembly as claimed in claim 6, wherein the support member is adapted to flex in the vicinity of the abutment means.

8. A magnetic catch comprising a magnetic assembly, the magnetic assembly including:

a magnet having front, rear, and side faces, a pair of pole members disposed respectively adjacent two opposite side faces of said magnet, each pole member comprising a portion which is proud of the front face of the magnet, a casing having at least one aperture for receiving the proud portions of the pole members, a unitary plate-like support member comprising abutment means disposed adjacent the rear face of the magnet, the abutment means being in the form of a localized protuberance extending proud of the support member, the support member being disposed to overlie the magnet and both pole members so as to limit their movement, and means for holding the support member such that the abutment means biases the magnet towards the aperture in the casing, the support member being adapted to allow movement of the pole member relative to the magnet in the force and aft direction;

the magnetic assembly further including a catch plate comprising material capable of attraction by the magnet.

9. A magnet catch as claimed in claim 8, wherein the casing comprises a pair of apertures for receiving the respective proud portions of the two pole members.

10. A magnetic catch as claimed in claim 8, wherein the abutment means is provided at a localised position on the support member.

11. A magnetic catch as claimed in claim 10, wherein the abutment means is substantially centrally disposed relative to the rear face of the magnet.

12. A magnetic catch as claimed in claim 8, wherein said protuberance is convex.

13. A magnetic catch as claimed in claim 8, wherein the support member is adapted to be flexible in the direction of the front face of the magnet.

14. A magnetic catch as claimed in claim 13, wherein the support member is adapted to flex in the vicinity of the abutment means.

* * * * *